US010997876B2

(12) United States Patent
Amron

(10) Patent No.: US 10,997,876 B2
(45) Date of Patent: May 4, 2021

(54) PRODUCE WASH LABEL

(71) Applicant: Scott Amron, Port Jefferson, NY (US)

(72) Inventor: Scott Amron, Port Jefferson, NY (US)

( * ) Notice: Subject to any disclaimer, the term of this patent is extended or adjusted under 35 U.S.C. 154(b) by 322 days.

(21) Appl. No.: 15/683,284

(22) Filed: Aug. 22, 2017

(65) Prior Publication Data

US 2017/0352299 A1 Dec. 7, 2017

Related U.S. Application Data

(63) Continuation-in-part of application No. 14/360,521, filed as application No. PCT/US2012/066350 on Nov. 21, 2012, now Pat. No. 10,347,158.

(60) Provisional application No. 61/629,652, filed on Nov. 23, 2011, provisional application No. 62/378,039, filed on Aug. 22, 2016.

(51) Int. Cl.

| | |
|---|---|
| ***G09F 3/00*** | (2006.01) |
| ***G09F 3/10*** | (2006.01) |
| ***G09F 3/02*** | (2006.01) |

(52) U.S. Cl.

CPC ..... *G09F 3/0291* (2013.01); *G09F 3/02* (2013.01); *G09F 3/10* (2013.01); *G09F 2003/0202* (2013.01); *G09F 2003/025* (2013.01); *G09F 2003/026* (2013.01); *G09F 2003/0211* (2013.01); *G09F 2003/0242* (2013.01); *G09F 2003/0283* (2013.01)

(58) Field of Classification Search

CPC ..... G09F 3/0291; G09F 3/10; G09F 3/02
USPC ..... 442/149
See application file for complete search history.

(56) References Cited

U.S. PATENT DOCUMENTS

| | | | |
|---|---|---|---|
| 3,472,675 | A | 10/1969 | Gordon et al. |
| 4,844,885 | A | 7/1989 | Chernack |
| 2006/0251891 | A1 | 11/2006 | Aarnio |
| 2009/0252905 | A1 | 10/2009 | Hill et al. |
| 2010/0285249 | A1 | 11/2010 | Mitchell et al. |
| 2011/0229675 | A1 | 9/2011 | Namikawa et al. |

OTHER PUBLICATIONS

D. Pham; Fruitwash: Produce labels that turn into soap to wash your fruits and veggies; Inhabitat.com; Oct. 2011.

N. Halverson; Fruit labels dissolve into organic soap; Discovery News; Nov. 2011.

C. Doctrow; Fruit labels that dissolve into fruit-wash; boingboing.net; Oct. 2011, 3 pages.

*Primary Examiner* — Vincent Tatesure
(74) *Attorney, Agent, or Firm* — Lucas & Mercanti, LLP

(57) ABSTRACT

A dissolvable produce washing label includes a dissolvable substrate impregnated with a produce cleanser; an adhesive layer; and a coating to seal and protect from water and humidity. When rubbed and washed with water by the end user the top coating wears and breaks to expose the dissolvable substrate, thereby dissolving the substrate and releasing the produce wash.

12 Claims, 3 Drawing Sheets

PRODUCE WASH LABEL

CROSS-REFERENCE TO RELATED APPLICATION

This application is a Continuation-in-Part of U.S. application Ser. No. 14/360,521, filed on May 23, 2014, which is a National Stage of International Application no. PCT/US2012/066350, filed on Nov. 21, 2012, which claims priority to U.S. Provisional Application No. 61/629,652, filed on Nov. 23, 2011. This application also claims priority to U.S. Provisional Application No. 62/378,039, filed on Aug. 22, 2016.

BACKGROUND OF THE INVENTION

The present invention relates to a water dissolvable or water dispersible produce label for individually labeling various fruits and vegetables and more specifically, to a dissolvable produce label that contains an organic cleansing produce wash to help clean the individually labeled fruit or vegetable by aiding in the removal of wax, dirt, bacteria, pesticides and fungicides. This invention further relates to a dissolvable produce-cleansing produce label that is water resistant in transit.

Current produce labels require removal by the end user. The end user must first peel the produce label off of each fruit individually and dispose of the label(s) before washing and/or eating. These labels are seen as a source of frustration by the end user. They are, for the most part, difficult to peel off and separate from your finger during disposal and add waste to an ever-growing trash problem. Also, current produce labels do nothing in the way of helping the user to clean their fruit. In fact, current fruit labels leave behind an adhesive residue that is very difficult to wash off with water alone.

The end user is warned against using detergent, laundry bleach or soap to clean their produce, as fruits and vegetables are porous and can absorb the soap or bleach. Therefore, produce washes have been formulated to help clean fruits and vegetables better than washing with water alone. There are currently dozens of companies manufacturing and selling "produce wash" as an expensive aftermarket cleansing solution to help consumers clean their fruits and vegetables. Manufacturers currently producing Produce Wash include: Veggie Wash, Eat Cleaner Fruit & Vegetable Wash, Fit Fruit & Vegetable Wash, Ultimate Fruit & Vegetable Wash, Mom's Veggiewash, Earth Friendly Fruit & Vegetable Wash, Enviro-one Fruit Wash, etc.

Produce labeling provides for fast and accurate checkout. In addition to offering basic product information, the PLU codes printed on produce labels also indicate whether a fruit is conventional, organic or genetically modified. Some labels now include a HarvestMark Number that provides additional information like where it was grown and whether or not the product is subject to a recall. With the HarvestMark number, the end user can also view photos of the farm, or the story behind the farmer, give feedback about the product they purchased, and discover nutrition information, and even recipes. Produce labels also provide branding space to build consumer trust. With branding in mind, fruit growers, distributors and supermarket chains are continually looking for opportunities to responsibly show their commitment to providing their customers with a clean product and a more enjoyable user experience.

It is desirable to have a fruit label that can be washed away; that leaves no adhesive residue behind; and that helps the end user clean their fruit. It is also desirable to offer a dissolvable fruit label that may be removed by "peeling it off" should the user choose to do so.

SUMMARY OF THE INVENTION

The present invention is directed toward a fruit label that overcomes one or more of the problems identified above. The aforementioned deficiencies are addressed, and an advance is made in the art, by a fruit label comprising: a water dissolving or water dispersing paper substrate (impregnated with at least one produce wash cleansing agent) having an upper surface and a lower surface; an adhesive layer having an upper surface and a lower surface wherein the upper surface of the adhesive layer is adhered to the lower surface of the dissolvable substrate; and a sealant coating overlying the upper surface of the dissolvable substrate to protect said dissolvable substrate from water and humidity.

A non-toxic, environmentally friendly and 100% biodegradable fruit label that dissolves in water into an organic fruit cleansing fruit wash to help remove wax, pesticides, dirt and bacteria when washed and rubbed with water by the end user is provided. The label is water resistant yet it dissolves when washed and rubbed with water, leaving behind or releasing a liquid produce cleansing wash designed to help remove wax, dirt and pesticides from the surface of the fruit it once labeled. This dissolving produce cleansing label has a water dissolvable or water dispersing substrate impregnated with a produce wash cleanser. The dissolvable substrate is sealed with a natural wax or varnish coating and employs an acrylic emulsion adhesive S692N. The user breaks the coating's seal by rubbing when washing with water. Once exposed to water, the substrate dissolves leaving behind or releasing a liquid produce wash. The wax coating requires a predetermined amount of mechanical agitation to break the seal and expose the dissolvable substrate. Should the end user choose not to wash the label off or does not have access to a water supply, they can simply remove the label by peeling it off the fruit like any other fruit label currently being used today. The dissolvable produce cleansing label is constructed to allow for normal sticker removal. The end user can choose to remove the label by simply peeling it off and throwing it away.

An object of the present invention is to provide a fruit label that dissolves into produce wash when washed and rubbed with water.

Another object of the present invention is to provide a fruit label that contains a cleansing agent that helps remove the label's adhesive residue.

A further object of the present invention is to provide a fruit label that would help clean the fruit it labels.

Another object of the present invention is to provide a fruit label that contains a cleansing agent that helps remove water-resistant wax, pesticides and fungicides.

Yet another object of the present invention is to provide a fruit label that dissolves away when washed yet it is water resistant enough to avoid prematurely dissolving if exposed to water, humidity and/or moisture in transit.

An object of the present invention is to provide a fruit label that the end user does not have to peel off and throw away.

Yet another object of the present invention is to provide fruit growers and suppliers another opportunity to show their commitment to providing a clean product with an improved user experience.

BRIEF DESCRIPTION OF THE DRAWINGS

The various features, functions and advantages characterizing the invention will be better understood by reference to the detailed description which follows, taken in conjunction with the accompanying drawings, in which.

DETAILED DESCRIPTION OF THE INVENTION

Figure 1:
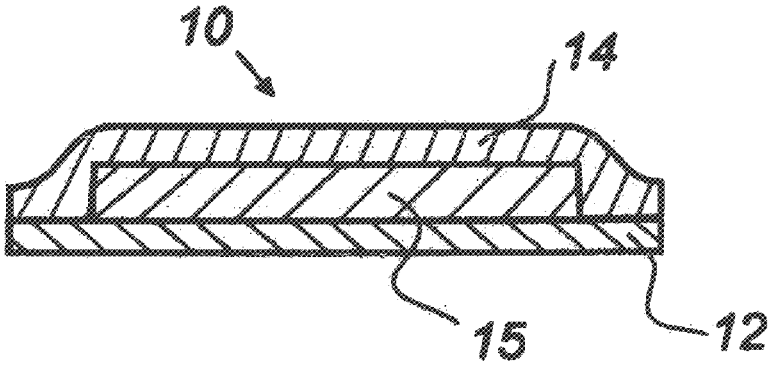
FIG. 1 is a sectional view of a label showing a water dissolvable/dispersible substrate with a bottom adhesive layer and top sealant coating applied thereto.

FIG. 1 shows the cross-section of a label constructed in accordance with the first preferred embodiment of the present invention shown generally at 10. A dissolvable paper substrate 15 is made of Sodium Carboxyl Methyl Cellulose and wooden pulp and is impregnated with at least one produce-cleansing agent. Typical produce cleansing wash ingredients include oleic acid and glycerol from vegetable sources, potassium hydrate from basic minerals, baking soda from basic minerals, citric acid from corn starch and molasses, natural cleansing agents derived from plant oils, polysorbate-20 derived from sorbitol/berries, grapefruit seed extract and lemon-orange extract and plant- and citrus-based ingredients. Vinegar and lemon juice (weak organic acids) are also used as anti-microbial and anti-browning agents. (It is also within the scope of the present invention to separate the paper substrate and produce wash component into two separate layers or to substitute the paper substrate altogether with a dissolvable solidified produce cleansing substrate (like soap paper)). A goal in selecting the produce cleansing agent is to provide an effective cleansing ingredient that does not add smell or taste to the produce being washed. The produce cleansing wash ingredients may also include ingredients that include seeds, microbeads, or baking soda or other material that provides a grit for effecting an abrasive, mechanical washing of the produce as well as chemical washing of the produce. Furthermore, the particular cleansing agents used can be tailored to the particular produce on which it is applied. For example, a peach skin has a different texture than an apple skin.

An acrylic adhesive 12 serves to attach the label to the side of a fruit and is in contact with the lower surface of the dissolvable paper substrate 15. Instead of an acrylic adhesive, any other known or hereafter developed food-grade adhesive can be used. A protective layer 14 such as a natural wax coating, clear acrylic sealant, polyethelene, varnish, or the like is applied to protect the water-soluble paper substrate and produce cleansing agent from water and moisture. In the preferred embodiments described below, a natural wax coating is used. However, in any of the embodiment, the clear acrylic sealant, polyethelene, or varnish can also be used. Generally, natural wax sources are plants, food-grade petroleum products, or insects (similar to honey combs from bees). Another example of a natural wax coating is a canauba wax. The attached article describes various ingredients that may be used in a natural wax. Extensive research by governmental and scientific authorities has shown that approved waxes are safe to eat. Waxes are indigestible, which means they go through the body without breaking down or being absorbed. Food grade edible ink is printed onto the surface of the paper substrate. Edible ink typically comprises at least one edible glycol and an edible colorant. (It is within the scope of the present invention to print directly onto the protective layer 14.)

The protective layer 14 is frangible in that it breaks when exposed to pressures or forces exerted on the fruit during a normal hand cleaning process. Once the protective layer breaks, the substrate 15 is exposed to water and dissolves. As the substrate dissolves, the produce-cleansing agent is released.

Figure 2:
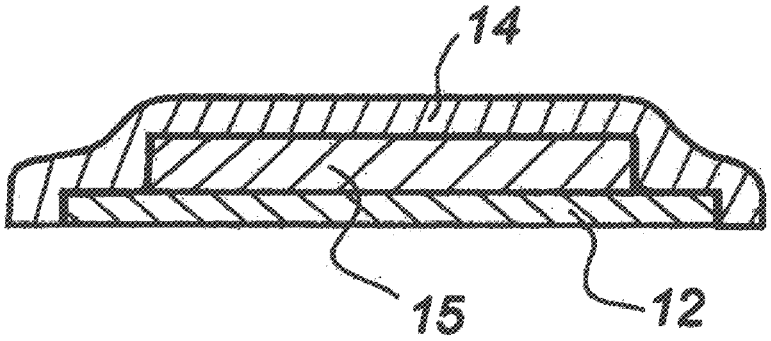
FIG. 2 is a sectional view of a label constructed in accordance with the present invention.
Figure 3:
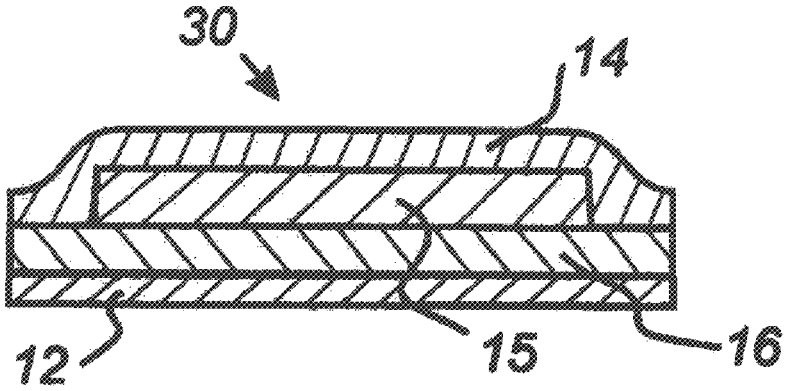
FIG. 3 is a sectional view of a label constructed in accordance with the present invention.
Figure 4:
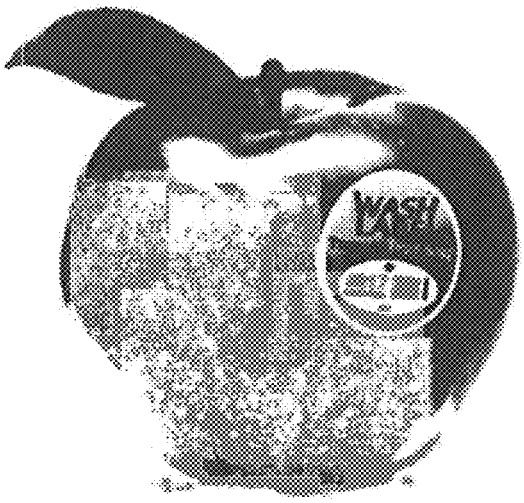
FIG. 4 is a plan view of the a printed label constructed in accordance with the present invention.
Figure 5:
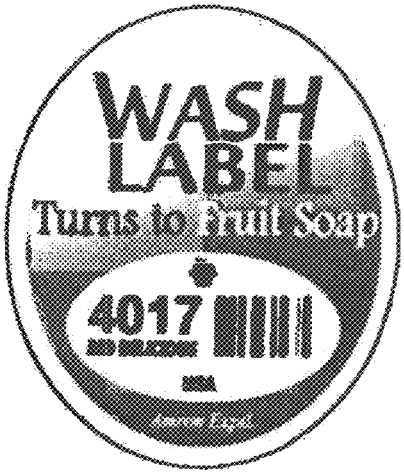
FIG. 5 is a photo of a label constructed in accordance with the current invention attached to an apple.

With reference to FIG. 2 one can see that the edges of a label constructed with a dissolvable adhesive layer 12 may require additional protective layer 14. FIG. 3 shows the dissolvable paper and produce cleanser substrate 15 sandwiched between a top protective layer 14 made of a wax coating and the bottom layer of wax coating 16. A layer of adhesive 12 is in contact with the bottom layer of wax 16. In a further embodiment, the top protective layer 14 and the bottom layer of wax coating 16 are one continuous layer that envelopes the substrate 15.

The produce cleansing wash will help remove any residue left behind by the label's adhesive 12. Unless, a water dissolving adhesive is employed. In which case the label leaves behind no adhesive residue to clean. Alternative coatings may be used to seal and protect the dissolvable components from water. The coating may be dried in an oven before it has an opportunity to deteriorate the surface of the paper substrate should this be an issue. Printing may be done directly onto the top sealant coating or directly onto the water dissolvable substrate. In an effort to conform to current printing practices, we anticipate potential need for an additional layer of coating such as a coating of a type which can be printed with direct thermal printing.

Enough fruit wash to clean a single fruit can be embedded in a label the size of a substantially flat fruit label. We have come up with a various methods of creating a fruit label that contains a produce wash to help clean the fruit when the user goes to wash his/her fruit. It is preferred to make the labels thicker rather than larger as the smaller we can keep the labels the less flexibility that is required to contour to the fruit's surface.

In one example embodiment, a Daymark inkjet printable dissolvable label is used as a dissolvable substrate. Mod Podge, a water based sealer made by Plaid Enterprise, Inc in Georgia, was used as the water resistant coating. The resultant label was extremely water resistant. But, when rubbed enough, the top coating wears and exposes the dissolvable paper substrate. The label would then dissolve away leaving behind no residue as the DayMark labels employs a dissolvable adhesive layer.

It is also within the scope of the present invention to construct a fruit label having a dissolvable paper substrate (without a produce wash cleansing component); an adhesive layer; and a wax coating. The produce cleansing wash component can be applied as part of the ink. In this case the ink would contain the produce cleansing wash.

It is also within the scope of the present invention to construct a fruit label having the substrate be made entirely of a sheet of solidified produce cleansing wash on which to coat or print directly. In this case, the substrate would not contain any dissolvable paper at all and it would consist entirely of a water soluble solidified produce cleanser (like soap paper).

It is also within the scope of the present invention to construct a fruit label having the ink printed directly onto a dissolvable adhesive layer with a sealant coating to protect it from water and humidity. In this case the ink would contain the produce cleansing agent.

It is also within the scope of the present invention to construct a fruit label having the produce cleansing wash component mixed in with a dissolvable adhesive, creating an adhesive layer/produce wash combination with a top water protectant layer to seal it. Or the solidified produce cleansing wash sheet may be made sticky enough to adhere to the side of a fruit.

In a further embodiment of the present invention, the substrate 15 may comprise a dissolvable film, such as an orally dissolving film use to deliver mouth-freshening products, instead of a dissolvable paper substrate. These orally dissolving films contain film-forming polymers such as hydroxypropylmethyl cellulose (HPMC), hydroxypropyl cellulose (HPC), pullulan, carboxymethyl cellulose (CMC), pectin, starch, polyvinyl acetate (PVA), and sodium alginate. Additional ingredients may include plasticizers and thickening agents. The orally dissolving films can be manufactured using one or a combination of processes including solvent casting, semisolid casting, hot melt extrusion, solid-dispersion extrusion, and rolling.

In the embodiment employing an orally dissolving film, the produce cleansing agent is carried in the film and is released when the film dissolves when exposed to water. The dissolving film may be used in any of the embodiments shown in FIGS. 1-3 described above. Instead of two separate protective layers on a top and bottom of the substrate as shown in FIG. 3, the substrate may be encapsulated in a protective coating to provide a reliable water-proof seal. In this embodiment, the information to be displayed by the label is printed directly on the dissolvable film or on the protective layer on top of the dissolvable film. The printing may be realized by any known printing method including stamping, flexo-printing, digital printing, or inkjet printing. In a further embodiment, a thermally printed label may be placed on the substrate.

Figure 6A:
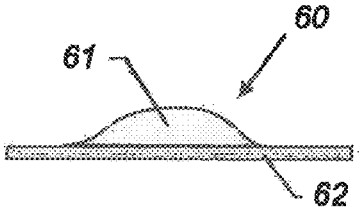
FIG. 6A-6B are a side view and top view of another embodiment of a label according to the present invention.
Figure 6C:
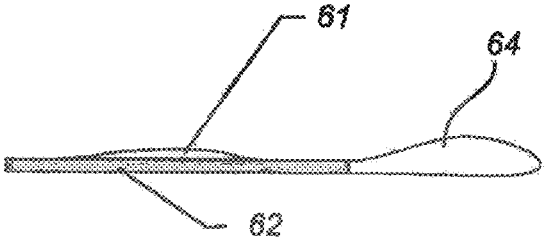
FIG. 6C-6D are a side view and top view during release of a produce cleaning agent.
Figure 6B:
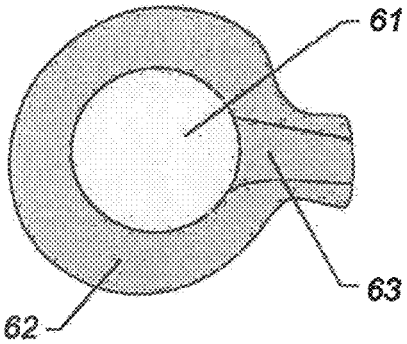
Figure 6D:
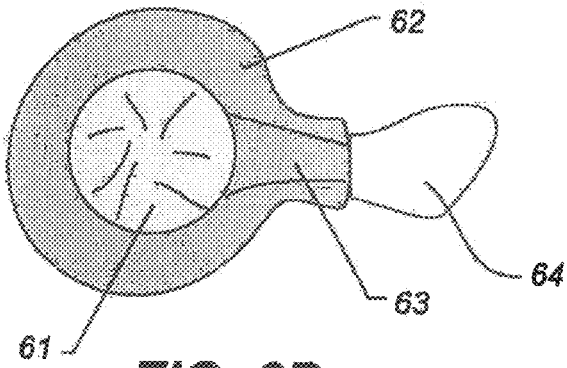

It is also within the scope of the present invention to construct a fruit label that is not dissolvable but still contains a produce wash. The Label would be a blister containing a drop of produce wash. The user would press the label to squeezes out the drop of produce wash onto the surface of the fruit or vegetable it is attached to. The label would then need to be peeled off and disposed of. The preferred embodiment of this version would be made of two thin PE layers housing a drop of produce wash. With reference to FIG. 6, one can see a fruit label constructed in accordance with this non-dissolvable instantiation of the present invention shown generally at 60. Two layers of thin PE plastic form a blister 61. The perimeter of the blister 62 is heat sealed. An escape channel 63 for the produce wash 64 to exit upon pressing the blister 61 is provide. FIG. 6A is a side view of the blister label before it is pressed. FIG. 6B is a plan view of the blister label before it is pressed. FIG. 6C is a side view of the blister label after it has been pressed. Once pressed, produce wash 64 is forced out through the channel 63 onto the surface of the fruit. FIG. 6D is a plan view of the blister label after it is pressed. Produce wash 64 is forced out when pressed by the end user.

While this invention has been illustrated and described in accordance with a first, second, third, fourth and fifth preferred embodiment of the present invention, it is recognized that variations and changes may be made therein. The term produce wash is used throughout to refer to any material or materials that may be used to safely help clean the surface of a fruit and or vegetable. It is also within the scope of the present invention to construct a dissolvable fruit label that is water resistant and requires a minimum amount of mechanical agitation (rubbing) to convert it from a water resistant Fruit Label to a water-dissolving fruit label with no produce cleanser component.

The invention claimed is:

1. A produce label, comprising:

a produce-cleansing agent;

a dissolvable substrate, wherein the dissolvable substrate is a film including at least one film-forming polymer selected from the group consisting of hydroxypropylmethyl cellulose, hydroxypropyl cellulose, pullulan, carboxymethyl cellulose, polyvinyl acetate, and sodium alginate, and the produce-cleansing agent is carried in the film.

2. The produce label of claim 1, further comprising an adhesive disposed on one side of the dissolvable substrate.

3. The produce label of claim 1, further comprising a protective coating encapsulating the dissolvable substrate.

4. The produce label of claim 1, wherein information to be displayed by the label is printed on the dissolvable substrate using an ink.

5. The produce label of claim 3, wherein information to be displayed by the label is printed on the protective coating using an ink.

6. The produce label of claim 3, wherein the protective coating is a wax coating.

7. The produce label of claim 1, further comprising protective coating disposed on at least one side of the film.

8. The produce label of claim 7, wherein the protective coating or a further layer is printed via thermal printing.

9. The produce label of claim 1, further comprising an adhesive layer, wherein ink is printed on the adhesive layer.

10. The produce label of claim 3, wherein the protective coating is frangible so that it breaks apart in response to mechanical agitation during a manual wash of the produce, whereby the dissolvable substrate dissolves after the water resistant coating is broken, leaving no residue on the produce.

11. The produce label of claim 10, wherein information to be displayed by the label is printed directly on the dissolvable substrate or on the protective coating with an ink.

12. The produce label of claim 11, further comprising a dissolvable adhesive layer.

* * * * *